US005906196A

United States Patent [19]

Measom

[11] Patent Number: 5,906,196

[45] Date of Patent: May 25, 1999

[54] PORTABLE STOVE WITH SELF-STORED LEGS

[75] Inventor: S. Ty Measom, Logan, Utah

[73] Assignee: Dutro Company, Emeryville, Calif.

[21] Appl. No.: 08/804,804

[22] Filed: Feb. 24, 1997

[51] Int. Cl.[6] ..... F24C 15/08; A22C 21/00

[52] U.S. Cl. ..... 126/304 A; 126/29; 126/9 R; 108/106; 248/188

[58] Field of Search ..... 126/9 R, 33, 25 R, 126/39 R, 304 A, 304 R, 305, 58, 59, 222, 225, 29; 108/106, 180, 148, 144, 145, 54.1, 56.1; 248/163.1, 158.13, 165, 172, 188, 188.8, 220.1, 529

[56] References Cited

U.S. PATENT DOCUMENTS

| | | | |
|---|---|---|---|
| 718,412 | 1/1903 | Bach et al. | 126/9 R |
| 1,130,747 | 3/1915 | Lozano | 126/29 |
| 1,372,032 | 3/1921 | Mandry | 248/188 |
| 1,645,421 | 10/1927 | Gloekler | 248/188 |
| 1,881,475 | 10/1932 | Gibson | 248/188 |
| 2,020,503 | 11/1935 | Hanson et al. | 126/304 A |
| 2,055,564 | 9/1936 | Tinnerman | 126/304 A |
| 2,511,594 | 6/1950 | Loffredo | 126/9 R |
| 2,515,521 | 7/1950 | Loffredo | 126/29 |
| 2,852,016 | 9/1958 | Weatherwax | 126/29 |
| 2,922,414 | 1/1960 | Brender | 126/29 |
| 4,624,238 | 11/1986 | Hait | 126/9 R |
| 4,911,140 | 3/1990 | Robinson | 126/29 |
| 5,119,799 | 6/1992 | Cowan | 126/9 R |
| 5,425,520 | 6/1995 | Masumoto | 248/188 |

FOREIGN PATENT DOCUMENTS

| | | | |
|---|---|---|---|
| 1112951 | 3/1956 | France | 248/188 |

*Primary Examiner*—Ira S. Lazarus
*Assistant Examiner*—David Lee
*Attorney, Agent, or Firm*—Harris Zimmerman

[57] ABSTRACT

A portable gas stove includes a rectangular housing defined by parallel front and rear panels joined to parallel, opposed side panels. A top opening at an upper end of the housing provides access to at least one burner, and a hinged cover is adapted to pivot to close the upper opening entirely. At the bottom end of the housing, a coffer is formed with a downward opening, and a pair of flanges extending inwardly at the side edges of the coffer are dimensioned to retain the disassembled stove legs disposed therebetween. A clamp is provided to secure the legs in the coffer for travel with the stove. Each leg includes a tubular main portion, and a top end having an L-section. The L-section is dimensioned to fit in complementary fashion over any corner vertex formed by the conjunction of a side and front or rear panel of the housing. Each corner vertex includes a slot extending vertically therein, and a nut is slidably supported by a nut holder for translation along the slot. A mounting screw extends through the apex of the L-section to engage the nut within the slot, whereby the upper end of each leg may be secured to a corner of the housing. Translation of each nut in its respective slot is possible when the mounting screw is engaged but not tightened in the nut, permitting vertical adjustment of each leg before the nut is tightened. Thus the stove may be leveled to obtain stable support on uneven terrain.

17 Claims, 5 Drawing Sheets

PORTABLE STOVE WITH SELF-STORED LEGS

BACKGROUND OF THE INVENTION

The present invention relates to portable gas stoves, and, more particularly, to a portable stove having removable, self-storing legs.

Portable stoves are used primarily for camping activities, as well as food preparation in temporary locations for outdoor events such as weddings and other celebrations, mobile food vendors, emergency food preparation during disaster relief operations, and the like. The use of portable stoves in such circumstances requires primarily that the stoves be capable of easy setup and disassembly for transport, and adaptable to the vagaries of terrain, siting, and other factors. It is recognized that a portable stove should be operated in a leveled condition, to prevent spills from pots and pans heated thereon, and that a portable stove be supported firmly at a height that is convenient for cooking tasks. The combined effect of these requirements is that portable stoves must often be supported on legs or other extendable supports, and that these legs should be removable for easy transport. Although some portable stoves are operatively associated with folding support structures, these assemblies may become unstable or difficult to use effectively under field conditions and repeated use.

It is important that removable legs be transported with the stove, as the stove is far less usable without the legs. However, most portable stoves do not provide any means for securing the legs to the stove in the knockdown condition. Moreover, the means for securing the legs to the stove must be operable easily and quickly, and all fastener means must be secured without risk of loss. These desirable features are not known in any prior art portable stove.

SUMMARY OF THE PRESENT INVENTION

The present invention generally comprises a portable gas stove that is adapted to be transformed from a knockdown configuration in which it is enclosed and protected to a setup configuration in which the burners are uncovered and screened from wind. Moreover, the stove legs are removed from the stove in the knockdown configuration, and the stove includes a storage compartment for the legs so that the legs travel with the stove during transport thereof. In addition, the stove includes leg mounting assemblies that permit vertical adjustments of each leg for leveling, as well as simple mounting fasteners for easy assembly and removal of the legs.

The portable stove is comprised generally of a rectangular housing defined by parallel front and rear panels joined to parallel, opposed side panels. A top opening at an upper end of the housing provides access to at least one burner, and a cover hinged to the upper edge of the rear panel of the housing is adapted to pivot to close the upper opening entirely. At the bottom end of the housing, a coffer is formed with a downward opening, and a pair of flanges extending inwardly at the side edges of the coffer are dimensioned to retain the disassembled stove legs disposed therebetween. A clamp is provided to secure the legs in the coffer for travel with the stove.

Each leg includes a tubular main portion, and a top end forged or otherwise formed as an angle iron section having an L-configuration. The L-configuration is dimensioned to fit in complementary fashion over any corner vertex formed by the conjunction of a side and front or rear panel of the housing. The corner vertex is provided with a slot extending vertically therein, and a nut is slidably supported by a nut holder for translation along the slot. A mounting screw is secured through the apex of the L-configured end of the leg, and a lock washer secures the mounting screw to each upper leg section to prevent loss of the screw.

The mounting screw is adapted to engage the nut within the slot in the corner vertex, whereby the upper end of each leg may be secured to a corner of the housing. The engagement of the L-shaped end of the leg with the corner vertex assures precise and rigid angular orientation of each leg with respect to the housing when the mounting screw is hand-tightened. However, translation of each nut in its respective slot is possible when the mounting screw is engaged but not tightened in a respective nut, permitting vertical adjustment of each leg within the limits of the length of the slot. Thus the stove may be leveled and configured to obtain stable support on uneven terrain.

DESCRIPTION OF THE PREFERRED EMBODIMENT

The present invention generally comprises a portable gas stove having an improved design that permits the stove to be leveled and supported on uneven ground, and that employs support legs that may be removed and stored within the stove for storage and transport.

Figure 1:
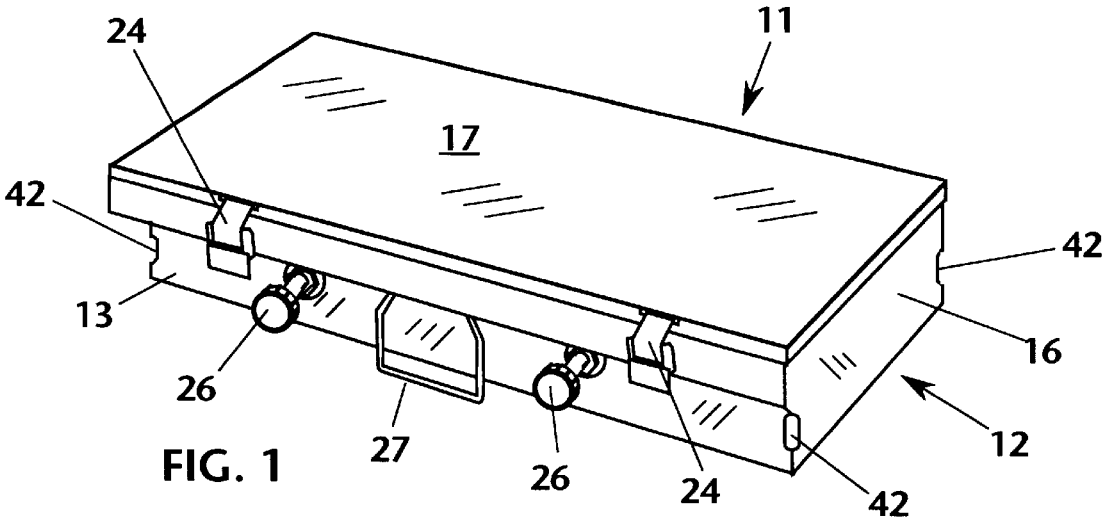
FIG. 1 is a perspective view of the portable gas stove of the present invention, shown in a closed disposition.
Figure 2:
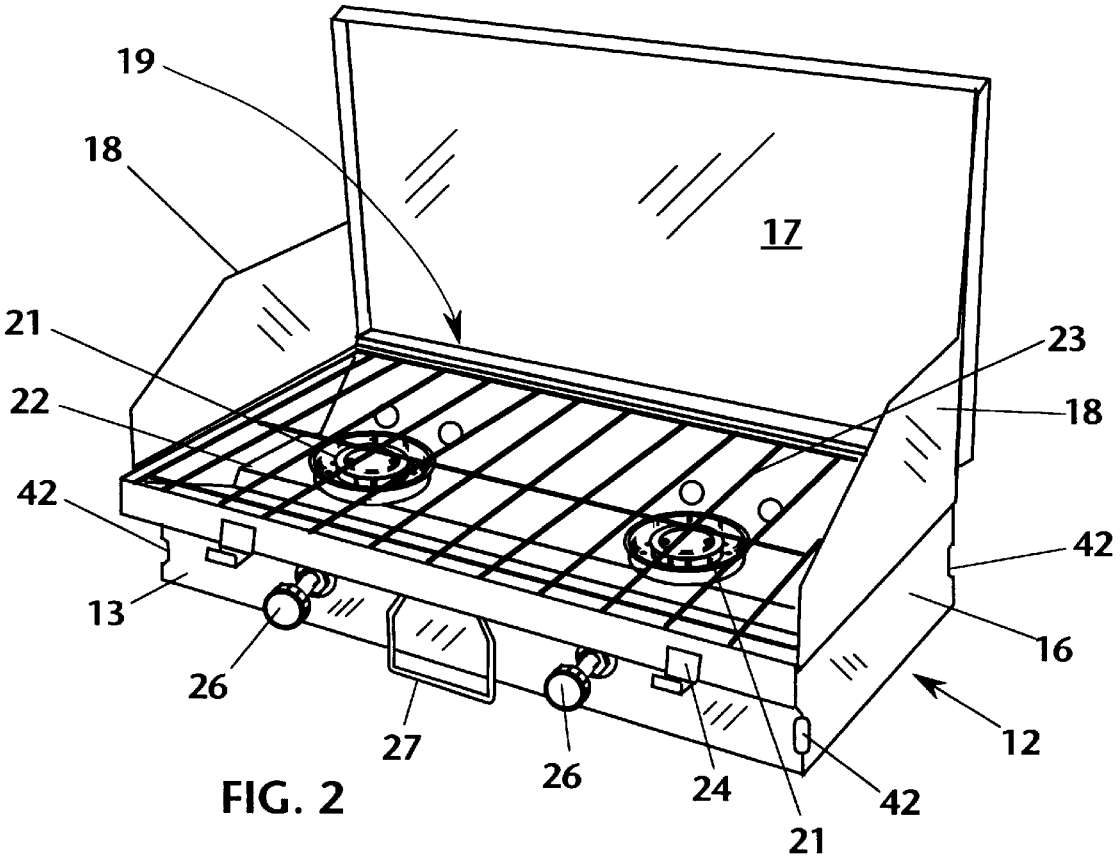
FIG. 2 is a perspective view of the portable gas stove of the present invention, shown in an open disposition with the legs detached.
Figure 3:
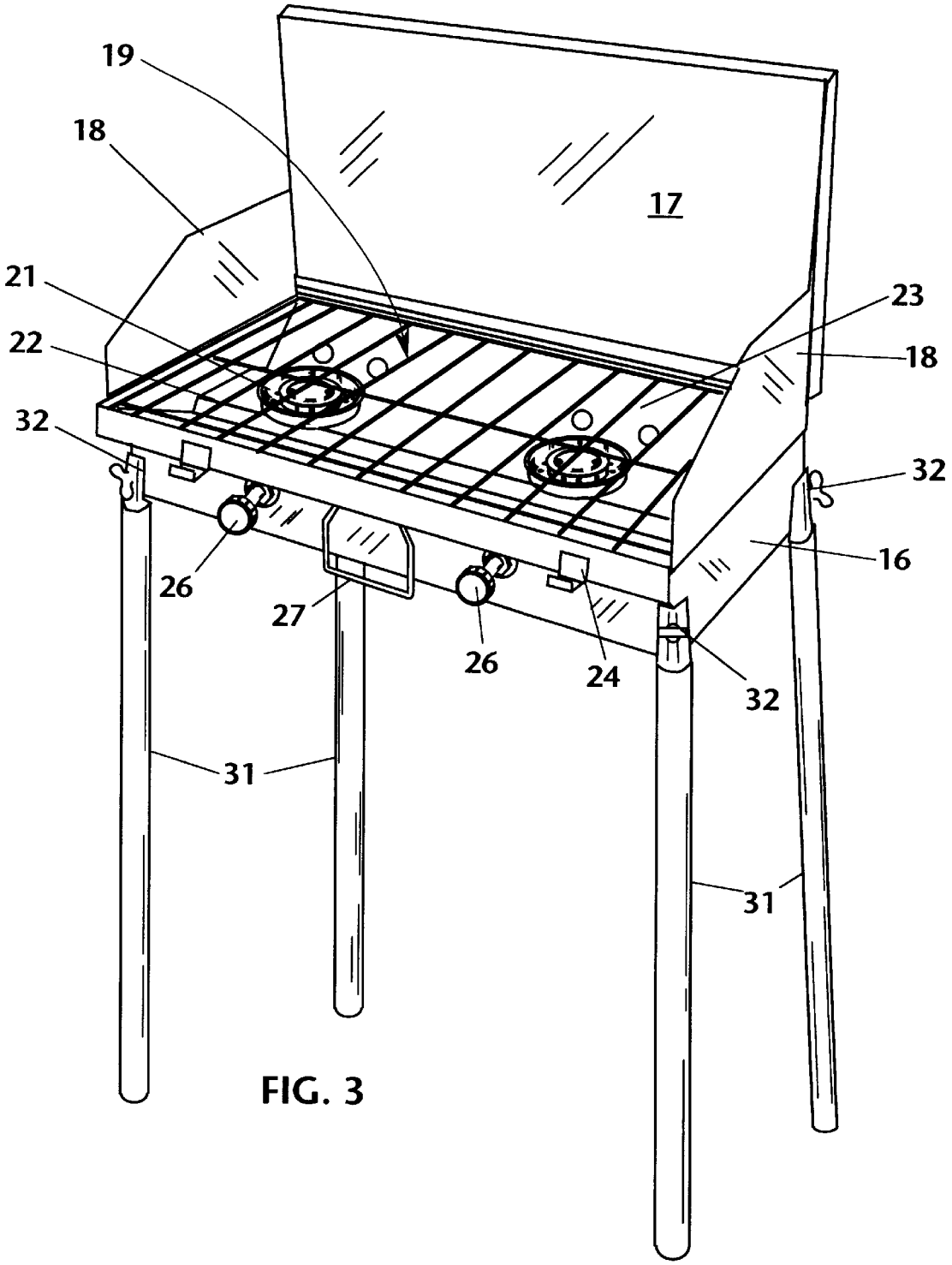
FIG. 3 is a perspective view of the portable gas stove of the present invention, shown in an open disposition with the legs assembled.

With regard to FIGS. 1–3, the portable gas stove 11 includes a generally rectangular housing 12 formed by a front panel 13, a back panel (not shown), and two side panels 14 (see FIGS. 5 and 7) and 16. A rectangular cover 17 is hingably secured to the housing 12 at the upper edge of the rear panel, and adapted to cover the upper opening 19 of the housing 12. Wind screen panels 18 are hinged to opposed side edges of the cover 17, whereby the wind screen panels may be pivoted to impinge against the cover 17 for closure thereof, or to be opened outwardly and deployed to deflect wind from the upper opening 19, as shown in FIG. 2.

Within the opening 19, a pair of gas burner assemblies 21 is supported on an interior panel 22. The gas burner assemblies may be of conventional design, or may conform to the unique design disclosed in U.S. patent application Ser. No.

08/xxx,xxx, filed XXXXXXXX by the present inventor. A grill 23 extends over the opening 19 to support pots and pans superjacently of the burners 21 for heating and cooking. A pair of latch assemblies 24 is secured to the front panel 13 and disposed to secure the cover 17 in the closed position, as in FIG. 1. Also secured to the front panel 13 is a pair of gas valves 24 which control gas flow (and flame height and heat output) for each of the burner assemblies 21. A pivoting handle 27 secured to the front panel 13 enables the user to pick up and carry the stove 11 when it is in the closed disposition of FIG. 1.

Figure 6:
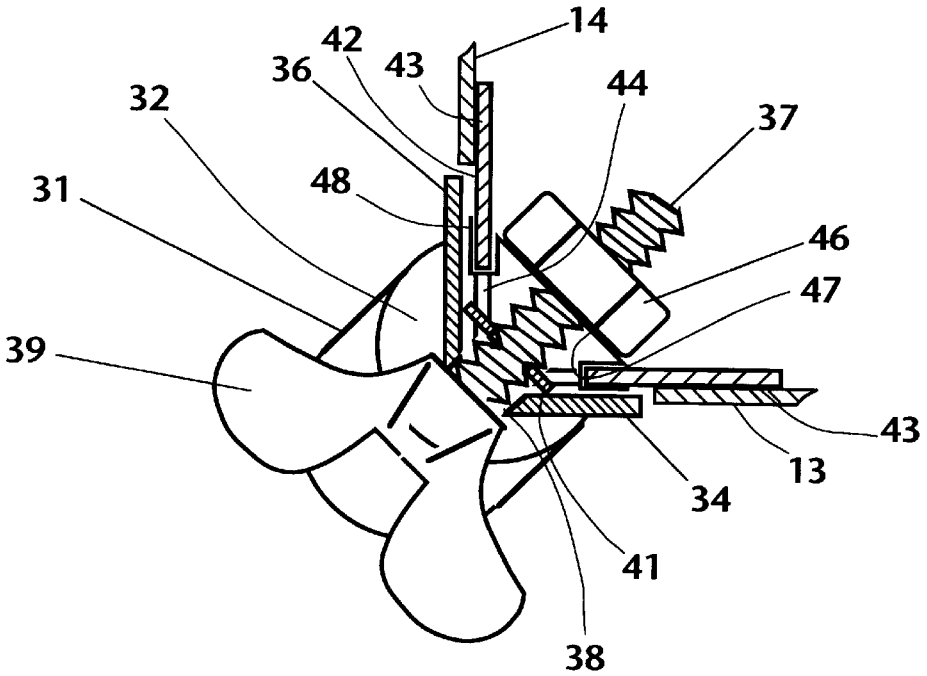
FIG. 6 is a cross-sectional view taken along line 6—6 of FIG. 5, showing the engagement of a leg and mounting screw in a vertical adjustment slot of the portable stove.

The stove of the invention further includes a quartet of leg assemblies 31, as shown in FIG. 3, each leg 31 having a ground-engaging lower end and an upper end 32 adapted to releasably engage the housing 12. With regard additionally to FIG. 4, the upper end 32 is provided with an end portion 33 formed as an angle iron section comprised of end panels 34 and 36 extending from a common vertex in an L-configuration. With reference also to FIG. 6, a mounting screw 37 extends through a hole 38 in the vertex of the L section, the mounting screw having a winged handle end 39 at the outer end. A lock washer 41 is secured to the screw 37 and disposed within the included angle of the panels 34 and 36, the handle 39 and lock washer 41 preventing removal of the mounting screw from the hole 38.

Figure 4:
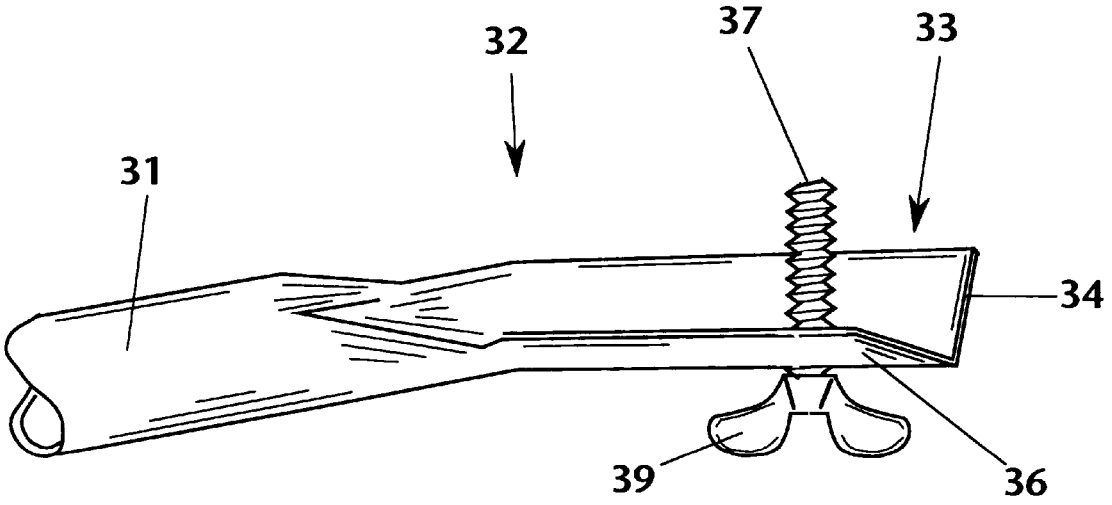
FIG. 4 is a perspective view of the upper end of a stove leg formed in accordance with the present invention.

In the preferred embodiment of the leg assembly, as shown in FIG. 4, the leg assembly 31 is formed of stock metal tube or pipe, and the upper end portion 32 is formed integrally by forging, molding, or otherwise forming the upper end of the tube into the panels 34 and 36. Alternatively, the upper end 32 may be formed as a cap that may be molded and assembled to any convenient form of leg stock material.

Figure 5:
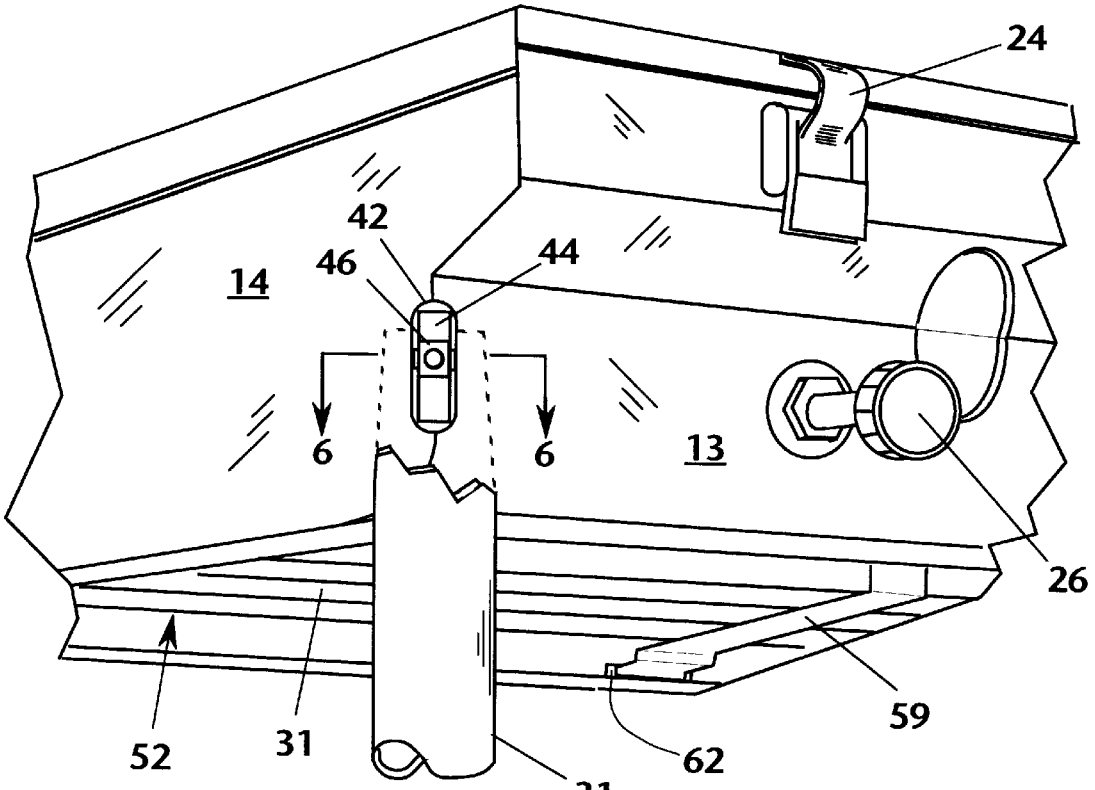
FIG. 5 is a perspective view of one corner vertex of the portable stove of the invention, showing the vertical adjustment slot.

A salient feature of the housing 12 is the provision of a quartet of slots 42, each disposed at the vertex formed by a front or back panel and one of the side panels 14 or 16. With reference to FIGS. 5 and 6, each slot extends through a corner vertex at an angle of approximately 45° to the conjoining side and front or rear panel. Within the housing 12, an interior panel 43 is provided with slots 44, each slot 44 disposed parallel and spaced inwardly from a slot 42. A nut 46 is disposed adjacent to the slot 44 and is supported by a sliding bracket 47. The bracket 47 includes opposed, flanged sides 48 that slidably engage the vertical edges of the slot 44, so that the nut 46 is variably positionable along the slot 44 and, likewise, slot 42. This assembly of components associated with slots 42 and 44 is substantially the same for all four vertical corners of the housing 12.

As shown in FIG. 6, the end portion 33 of any leg assembly 31 may engage any of the vertical corners of the housing 12, the corner vertex of the housing fitting in complementary fashion within the included angle of the panels 34 and 36. The mounting screw may be extended through the slots 42 and 44 and threaded into the nut 46, and the nut 46 may be translated slidably along slot 44 to adjust the vertical position of the leg with respect to the housing 12. When the mounting screw 37 is tightened (by use of the handle 39), frictional compression on the sliding bracket 47 immobilizes the bracket and nut, whereby the vertical position of the leg 31 is fixed. At the same time, the complementary fit of the angle iron section 33 and the vertical corner of the housing forms a strong and rigid supporting assembly.

Figure 7:
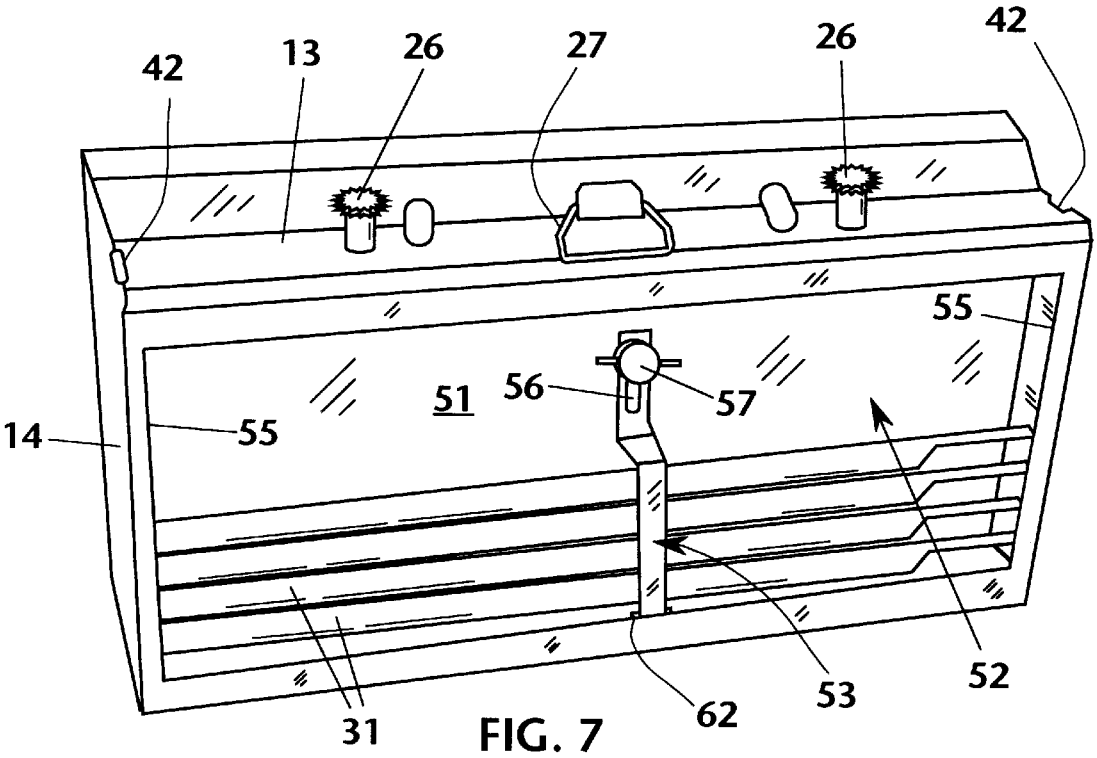
FIG. 7 is a perspective bottom view of the portable gas stove of the invention, showing the leg self-storage feature of the stove.
Figure 8:
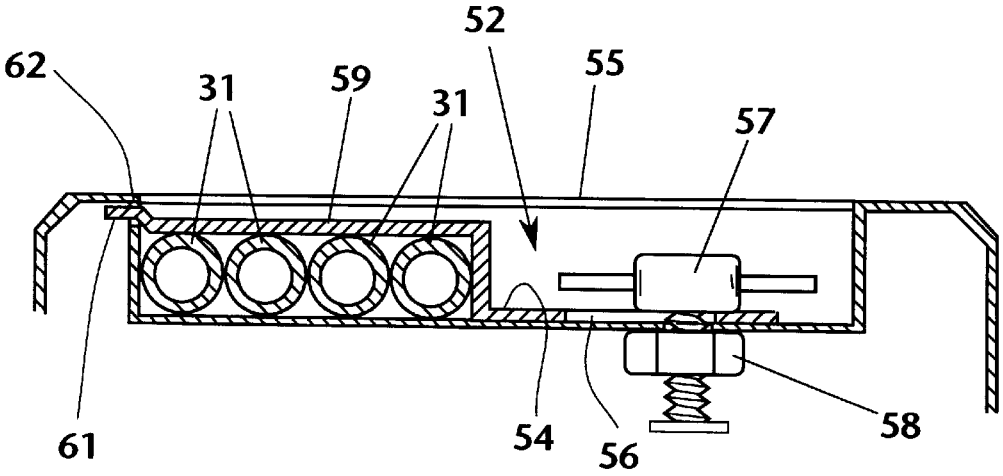
FIG. 8 is a partial cross-sectional elevation of the leg self-storage feature of the portable gas stove of the invention.

Another salient feature of the invention is the provision of a storage compartment for securing the legs 31 when they are disassembled from the housing 12. As shown in FIGS. 7 and 8, the bottom panel 51 of housing 12 is recessed within the side panels and front and rear panels to define a rectangular coffer 52 that opens downwardly. Flanges 55 converge inwardly from the lower edges of side panels 14 and 16 to form a coffer opening slightly narrower than the coffer 52 itself. The interior wide of the coffer 52 from side to side is approximately equal to the length of the leg assemblies 31 (including upper end 32), so that the leg assemblies may extend across the width of the coffer 52 and be retained within the flanges 55. A leg assembly 31 may be placed in the coffer or removed therefrom by orienting it generally in a diagonal direction to avoid engaging the flanges 55.

A bracket 53 for securing the legs 31 within the coffer 52 includes a base panel 54 and a blade 59 extending therefrom in offset, dogleg fashion, as shown in FIGS. 7 and 8. The base panel 54 includes a slot 56 extending in a direction opposite to the blade 59. A screw fastener 57 extends through the slot 56, and is secured in a threaded fastener 58 at the interior of the floor panel 51. The length of the blade 59 is dimensioned to accommodate the four legs 31 of the stove assembly. The distal end of the blade 59 is provided with a tip 61 that is adapted to engage a slot 62 in the rear wall of the coffer 52. With the tip 61 in slot 62, the fastener 57 may be tightened to secure the bracket and lock the leg assemblies in place within the coffer 52. To remove the leg assemblies, the fastener 57 is loosened, the bracket 53 is slidably translated away from the slot 62 to free the tip 61, and the bracket 53 is rotated about the fastener 57 away from engagement with the legs. The leg assemblies may then be angled diagonally and removed from the coffer 52.

The self-storage of the leg assemblies 31 within the housing 12 of the invention provides a convenient means for transporting the legs with the stove and assuring the legs will arrive with the stove at any destination. Furthermore, the leg assemblies are stored within the bottom profile of the stove, the bottom configuration of the stove permitting it to be supported directly on an existing horizontal surface at a convenient cooking height, such as a table, counter top, vehicle tailgate, or the like.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. A portable stove, including:

a housing for supporting at least one burner, said housing including a plurality of corners;

a plurality of leg assemblies, each having a lower end adapted to be ground-engaging and an upper end adapted to engage one of said plurality of corners;

means for releasably securing said upper end of each leg assembly to one of said plurality of corners; and, means for securing and storing said plurality of leg assemblies in said housing;

said upper end of each of said leg assemblies including an angle iron portion having two panels extending from a common spine and defining an included angle therebetween; and, a plurality of mounting screws, each extending through said spine of one of said angle iron portions.

2. The portable stove of claim 1, wherein said included angle of said angle iron portion of any of said plurality of leg assemblies provides a complementary fit to any of said corner of said housing.

3. The portable stove of claim 1, further including a plurality of slot means, each slot means extending through a corner of said housing, a plurality of nuts, each adapted to engage one of said mounting screws, and means for slidably supporting each of said nuts within said housing for translation along one of said slot means.

4. The portable stove of claim 3, wherein said means for slidably supporting including a sliding bracket having opposed side flanges, said side flanges engaging said slot means in slidable fashion, one of said nuts secured to each of said sliding brackets.

5. The portable stove of claim 4, wherein said slot means includes a first slot extending through one of said corners of said housing.

6. The portable stove of claim 5, wherein said slot means includes a second slot formed in an interior structural member of said housing, said second slot extending substantially parallel and spaced apart from said first slot, said sliding bracket engaging opposed side edges of said second slot.

7. A portable stove, including:

a housing for supporting at least one burner, said housing including a plurality of corners;

a plurality of leg assemblies, each having a lower end adapted to be ground-engaging and an upper end adapted to engage one of said plurality of corners;

means for releasably securing said upper end of each leg assembly to one of said plurality of corners; and, means for securing and storing said plurality of leg assemblies in said housing;

said means for securing and storing said plurality of leg assemblies including a storage compartment formed in said housing;

said storage compartment including a length dimension along one axis that is greater than the length dimension of said leg assemblies, whereby said leg assemblies may be disposed parallel to said one axis and received within said storage compartment;

said storage compartment including an outer opening, and further including a pair of flanges disposed at said outer opening and converging along said one axis, the distance defined between said pair of flanges being less than said length dimension, whereby said flanges retain said leg assemblies within said storage compartment.

8. The portable stove of claim 7, further including clamping bracket means for securing said leg assemblies in said storage compartment.

9. The portable stove of claim 8, wherein said storage compartment includes a bottom panel on which said leg assemblies impinge, and said clamping bracket includes a blade portion, said blade portion adapted to extend in a first position parallel to said bottom panel and clamp said leg assemblies between said blade portion and said bottom panel.

10. The portable stove of claim 9, further including means for releasably securing said blade portion in said first position, whereby said clamping means may be moved to a second position in which said leg assemblies are freely removable from said storage compartment.

11. The portable stove of claim 10, wherein said means for releasably securing includes a threaded fastener extending through said bottom panel and said clamping means.

12. The portable stove of claim 11, wherein said storage compartment includes a sidewall and an opening formed in said sidewall, and said blade portion includes a tip portion adapted to be releasably retained in said opening when said blade is disposed in said first position.

13. The portable stove of claim 7, wherein said storage compartment comprises a coffer recess formed in a bottom portion of said housing.

14. The portable stove of claim 13, wherein said housing includes a bottom conformation adapted to be supported stably on a flat surface without recourse to support by said leg assemblies.

15. A portable stove, including:

a housing for supporting at least one burner therein, said housing including a plurality of corners;

a plurality of leg assemblies, each having a lower end adapted to be ground-engaging and an upper end adapted to engage one of said plurality of corners;

means for coupling said upper end of each leg assembly to one of said plurality of corners in height-adjustable fashion, including a plurality of slot means, each slot means extending through one of said corners of said housing, a plurality of fastener means, each extending from one of said upper ends of said leg assemblies and through a respective one of said slot means, and means within said housing for releasably securing said fastener means within said slot means.

16. The portable stove of claim 15, wherein said fastener means includes a plurality of screws, each extending from one of said upper ends of said leg assemblies, and said means for releasably securing includes a plurality of nuts adapted to receive said screws, and means for securing said nuts in slidable fashion in said second slots, whereby each of said screws may extend through a respective first slot to engage a respective nut in a respective second slot.

17. The portable stove of claim 16, wherein tightening each of each of said screws in its respective nut also immobilizes the respective means for securing the nut in slidable fashion in the second slot.

* * * * *